US012655637B2

(12) United States Patent
Prenosil

(10) Patent No.: US 12,655,637 B2
(45) Date of Patent: Jun. 16, 2026

(54) FOLDABLE RAMP SYSTEM

(71) Applicant: John M. Prenosil, Belchertown, MA (US)

(72) Inventor: John M. Prenosil, Belchertown, MA (US)

( * ) Notice: Subject to any disclaimer, the term of this patent is extended or adjusted under 35 U.S.C. 154(b) by 488 days.

(21) Appl. No.: 18/364,820

(22) Filed: Aug. 3, 2023

(65) Prior Publication Data

US 2024/0044143 A1 Feb. 8, 2024

Related U.S. Application Data

(60) Provisional application No. 63/395,450, filed on Aug. 5, 2022.

(51) Int. Cl.
*E04F 11/00* (2006.01)

(52) U.S. Cl.
CPC ..... *E04F 11/002* (2013.01); *E04F 2011/005* (2013.01)

(58) Field of Classification Search
CPC ..... E04F 11/002; E04F 2011/005
USPC ..... 14/69.5–71.3
See application file for complete search history.

(56) References Cited

U.S. PATENT DOCUMENTS 2,579,797 A * 12/1951 Churchfield ..... A01K 1/035 119/28.5
4,995,322 A 2/1991 Frederick
5,076,547 A * 12/1991 Osterholm ..... E04F 11/18 52/150
5,319,818 A 6/1994 Baranowski
5,535,848 A * 7/1996 Giuliano ..... A62B 1/20 182/113
6,957,716 B1 * 10/2005 Norris ..... A62B 5/00 296/61
7,010,825 B1 3/2006 Finch Salas et al.
7,185,381 B1 * 3/2007 Heartsill ..... A01K 1/035 14/71.1
7,240,388 B2 * 7/2007 Warford ..... E04F 11/002 14/69.5
7,350,254 B2 * 4/2008 Boulton ..... E01D 15/124 14/2.4
8,370,982 B2 * 2/2013 Peters ..... E04F 11/002 14/69.5
8,468,632 B1 * 6/2013 Ricci ..... E01D 15/124 193/41
2003/0234139 A1 * 12/2003 Burch ..... A62B 3/00 182/49
2005/0123380 A1 6/2005 Massaro
(Continued)

FOREIGN PATENT DOCUMENTS

CN 113123542 A 7/2021
FR 2653148 A1 * 4/1991 ..... E04F 11/062
(Continued)

*Primary Examiner* — Raymond W Addie
(74) *Attorney, Agent, or Firm* — The Webb Law Firm

(57) ABSTRACT

A foldable ramp system adjustable between a first position and a second position in which: in the first position, the foldable ramp system includes: a landing region substantially parallel to and elevated above a ground, where the landing region is mounted to a wall; and an inclined region extending from an end of the landing region toward the ground, where the inclined region is mounted to the wall; and in the second position, the landing region and the inclined region are folded against the wall.

15 Claims, 12 Drawing Sheets

(56) References Cited

U.S. PATENT DOCUMENTS

| | | | | |
|---|---|---|---|---|
| 2013/0055511 | A1* | 3/2013 | McGivern | E01C 15/00 14/69.5 |
| 2020/0308842 | A1* | 10/2020 | Jakubowski | A01K 15/027 |
| 2021/0164232 | A1* | 6/2021 | Bonner | E04F 11/1865 |
| 2022/0104626 | A1 | 4/2022 | Pinnock | |

FOREIGN PATENT DOCUMENTS

| | | | | |
|---|---|---|---|---|
| KR | 100738261 | B1 | 7/2007 | |
| KR | 102259165 | B1 * | 6/2021 | B60P 3/14 |

* cited by examiner

FOLDABLE RAMP SYSTEM

CROSS-REFERENCE TO RELATED APPLICATIONS

This application claims the benefit of U.S. Provisional Application No. 63/395,450, filed Aug. 5, 2022, the disclosure of which is hereby incorporated by reference in its entirety.

BACKGROUND

1. Field

The present disclosure relates to a foldable ramp system.

2. Technical Considerations

Riding animals can be trained to allow humans to ride on their backs. For example, humans commonly ride on horses, bulls, camels, and mules, among many other species of animals. However, mounting the riding animal can prove challenging for certain individuals, particularly for children and/or individuals with disabilities.

SUMMARY

The present disclosure is directed to a foldable ramp system adjustable between a first position and a second position in which: in the first position, the foldable ramp system includes: a landing region substantially parallel to and elevated above a ground, where the landing region is mounted to a wall; and an inclined region extending from an end of the landing region toward the ground, where the inclined region is mounted to the wall; and in the second position, the landing region and the inclined region are folded against the wall.

In some non-limiting embodiments or aspects, the landing region and the inclined region may be rotatably mounted to the wall so as to be configured to rotate between the first position and the second position. In the second position, the foldable ramp system may protrude less than 12 inches from the wall. The foldable ramp system may further include a handrail mounted to a top side of the landing region and/or a top side of the inclined region, where in the first position, the handrail may be substantially perpendicular to the landing region and/or the inclined region, and in the second position, the handrail may be substantially parallel to the landing region and/or the inclined region. The foldable ramp system may further include a plurality of supports mounted to a bottom side of the landing region and/or a bottom side of the inclined region, where in the first position, the plurality of supports may be substantially perpendicular to the landing region and/or the inclined region and/or engage with the ground, and in the second position, the plurality of supports may be substantially parallel to the landing region and/or the inclined region. The plurality of supports may be adjustable in length. The foldable ramp system may further include a plurality of supports mounted, on a first end, to a bottom side of the landing region and/or a bottom side of the inclined region and, on a second end, to the wall. The plurality of supports may be rotatably mounted to the bottom side of the landing region and/or the bottom side of the inclined region and the wall so as to facilitate adjustment of the foldable ramp system from the first position to the second position. The inclined region may constitute a ramp between the ground and the landing region. The foldable ramp system may further include a bracket mounted to the wall and configured to engage the landing region and the inclined region in the second position to secure the landing region and the inclined region to the wall in the second position. The foldable ramp system may further include a second handrail rotatably mounted to the wall and configured to rotate from a first position in which the second handrail is extended away from the wall to a second position in which the second handrail is in contact with the wall. The landing region may include a mounting region not including a handrail. The wall may be a component of a riding arena at least partially enclosing a riding area. The wall may be a fence.

The present disclosure is also directed to a riding arena including a wall at least partially enclosing a riding area, where the riding arena includes the foldable ramp system described herein mounted to the wall.

The present disclosure is also directed to a method of arranging a foldable ramp system, including: providing a foldable ramp system including: a landing region substantially parallel to and elevated above a ground, where the landing region is mounted to a wall; and an inclined region extending from an end of the landing region toward the ground, where the inclined region is mounted to the wall; and rotating the landing region and the inclined region against the wall.

In some non-limiting embodiments or aspects, the foldable ramp system may include a handrail mounted to a top side of the landing region and/or a top side of the inclined region, where the handrail may be substantially perpendicular to the landing region and/or the inclined region, where rotating the landing region and the inclined region may include rotating the handrail to be substantially parallel to the landing region and/or the inclined region. The foldable ramp system may include a plurality of supports mounted to a bottom side of the landing region and/or a bottom side of the inclined region, where the plurality of supports may be perpendicular to the landing region and/or the inclined region and/or the plurality of supports may engage the ground, where rotating the landing region and the inclined region may include rotating the plurality of supports to be substantially parallel to the landing region and/or the inclined region. The foldable ramp system may include a plurality of supports mounted, on a first end, to a bottom side of the landing region and/or a bottom side of the inclined region and, on a second end, to the wall, where rotating the landing region and the inclined region may include rotating the plurality of supports toward the wall.

The present disclosure also relates to the following clauses:

Clause 1: A foldable ramp system adjustable between a first position and a second position in which: in the first position, the foldable ramp system comprises: a landing region substantially parallel to and elevated above a ground, wherein the landing region is mounted to a wall; and an inclined region extending from an end of the landing region toward the ground, wherein the inclined region is mounted to the wall; and in the second position, the landing region and the inclined region are folded against the wall.

Clause 2: The foldable ramp system of clause 1, wherein the landing region and the inclined region are rotatably mounted to the wall so as to be configured to rotate between the first position and the second position.

Clause 3: The foldable ramp system of clause 1 or 2, wherein in the second position, the foldable ramp system protrudes less than 12 inches from the wall.

Clause 4: The foldable ramp system of any of clauses 1-3, further comprising a handrail mounted to a top side of the landing region and/or a top side of the inclined region, wherein in the first position, the handrail is substantially perpendicular to the landing region and/or the inclined region, and in the second position, the handrail is substantially parallel to the landing region and/or the inclined region.

Clause 5: The foldable ramp system of any of clauses 1-4, further comprising a plurality of supports mounted to a bottom side of the landing region and/or a bottom side of the inclined region, wherein in the first position, the plurality of supports are substantially perpendicular to the landing region and/or the inclined region and/or engage with the ground, and in the second position, the plurality of supports are substantially parallel to the landing region and/or the inclined region.

Clause 6: The foldable ramp system of clause 5, wherein the plurality of supports are adjustable in length.

Clause 7: The foldable ramp system of any of clauses 1-6, further comprising a plurality of supports mounted, on a first end, to a bottom side of the landing region and/or a bottom side of the inclined region and, on a second end, to the wall.

Clause 8: The foldable ramp system of clause 7, wherein the plurality of supports are rotatably mounted to the bottom side of the landing region and/or the bottom side of the inclined region and the wall so as to facilitate adjustment of the foldable ramp system from the first position to the second position.

Clause 9: The foldable ramp system of any of clauses 1-8, wherein the inclined region constitutes a ramp between the ground and the landing region.

Clause 10: The foldable ramp system of any of clauses 1-9, further comprising a bracket mounted to the wall and configured to engage the landing region and the inclined region in the second position to secure the landing region and the inclined region to the wall in the second position.

Clause 11: The foldable ramp system of any of clauses 1-10, further comprising a second handrail rotatably mounted to the wall and configured to rotate from a first position in which the second handrail is extended away from the wall to a second position in which the second handrail is in contact with the wall.

Clause 12: The foldable ramp system of any of clauses 4-11, wherein the landing region comprises a mounting region not comprising a handrail.

Clause 13: The foldable ramp system of any of clauses 1-12, wherein the wall is a component of a riding arena at least partially enclosing a riding area.

Clause 14: The foldable ramp system of any of clauses 1-13, wherein the wall is a fence.

Clause 15: A riding arena comprising a wall at least partially enclosing a riding area, wherein the riding arena comprises the foldable ramp system of any of clauses 1-14 mounted to the wall.

Clause 16: A method of arranging a foldable ramp system, comprising: providing a foldable ramp system comprising: a landing region substantially parallel to and elevated above a ground, wherein the landing region is mounted to a wall; and an inclined region extending from an end of the landing region toward the ground, wherein the inclined region is mounted to the wall; and rotating the landing region and the inclined region against the wall.

Clause 17: The method of clause 16, wherein the foldable ramp system comprises a handrail mounted to a top side of the landing region and/or a top side of the inclined region, wherein the handrail is substantially perpendicular to the landing region and/or the inclined region, wherein rotating the landing region and the inclined region comprises rotating the handrail to be substantially parallel to the landing region and/or the inclined region.

Clause 18: The method of clause 16 or 17, wherein the foldable ramp system comprises a plurality of supports mounted to a bottom side of the landing region and/or a bottom side of the inclined region, wherein the plurality of supports are perpendicular to the landing region and/or the inclined region and/or the plurality of supports engage the ground, wherein rotating the landing region and the inclined region comprises rotating the plurality of supports to be substantially parallel to the landing region and/or the inclined region.

Clause 19: The method of any of clauses 16-18, wherein the foldable ramp system comprises a plurality of supports mounted, on a first end, to a bottom side of the landing region and/or a bottom side of the inclined region and, on a second end, to the wall, wherein rotating the landing region and the inclined region comprises rotating the plurality of supports toward the wall.

DETAILED DESCRIPTION

Figure 1:
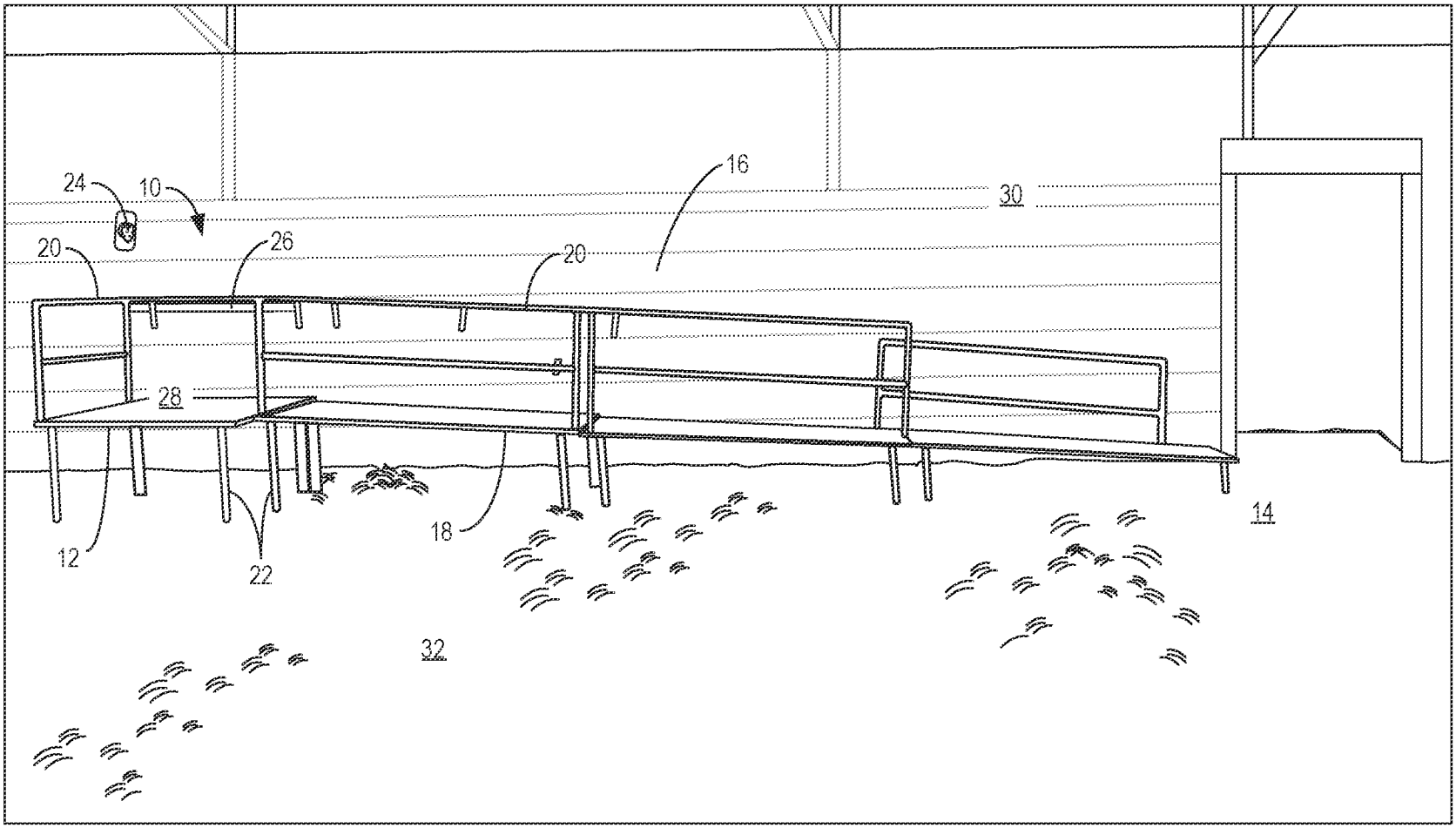
FIG. 1 shows a front perspective view of a foldable ramp system according to some non-limiting embodiments or aspects.
Figure 2:
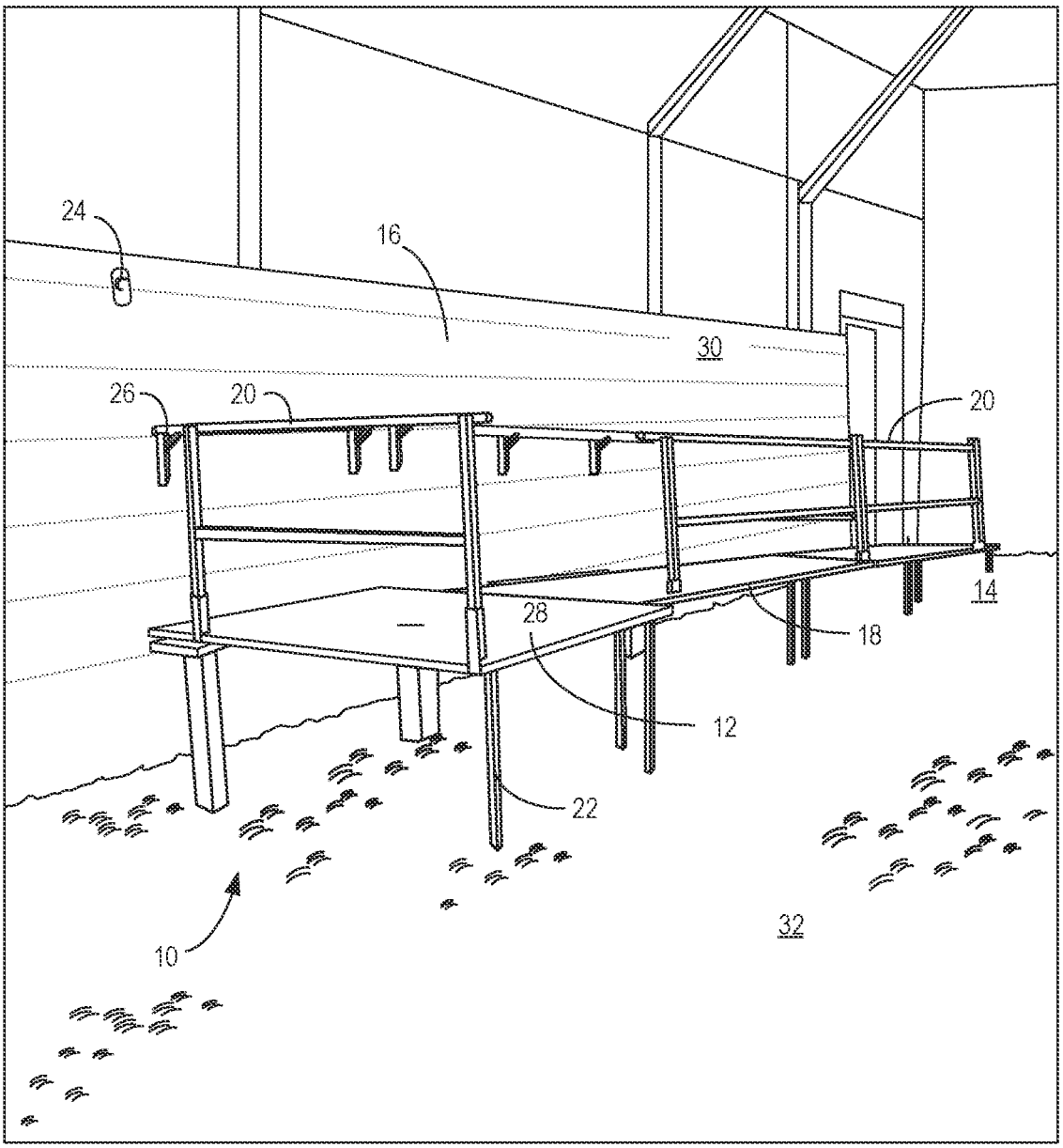
FIG. 2 shows a front perspective view of a foldable ramp system according to some non-limiting embodiments or aspects.
Figure 3:
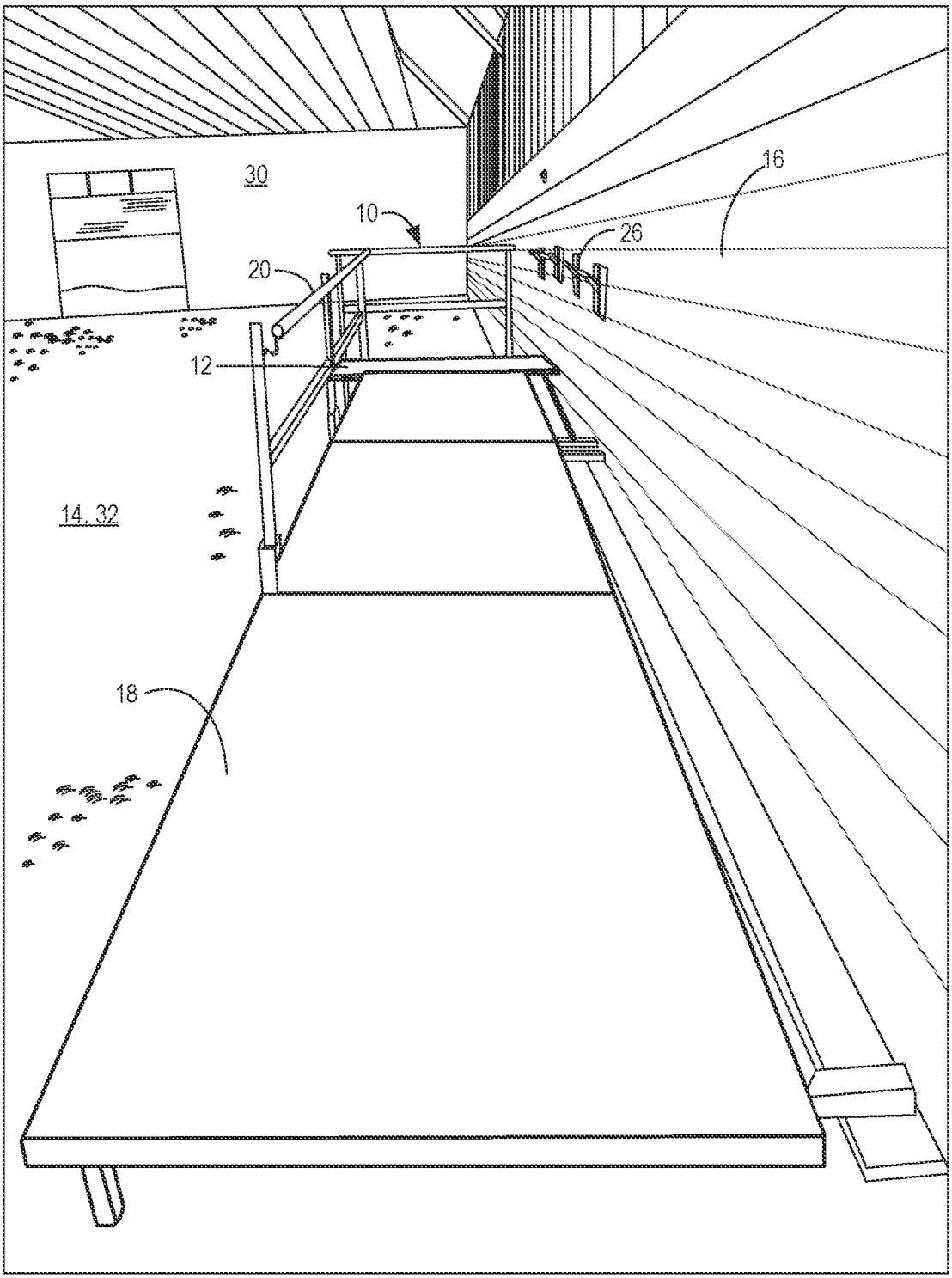
FIG. 3 shows a right side perspective view of a foldable ramp system according to some non-limiting embodiments or aspects.
Figure 4:
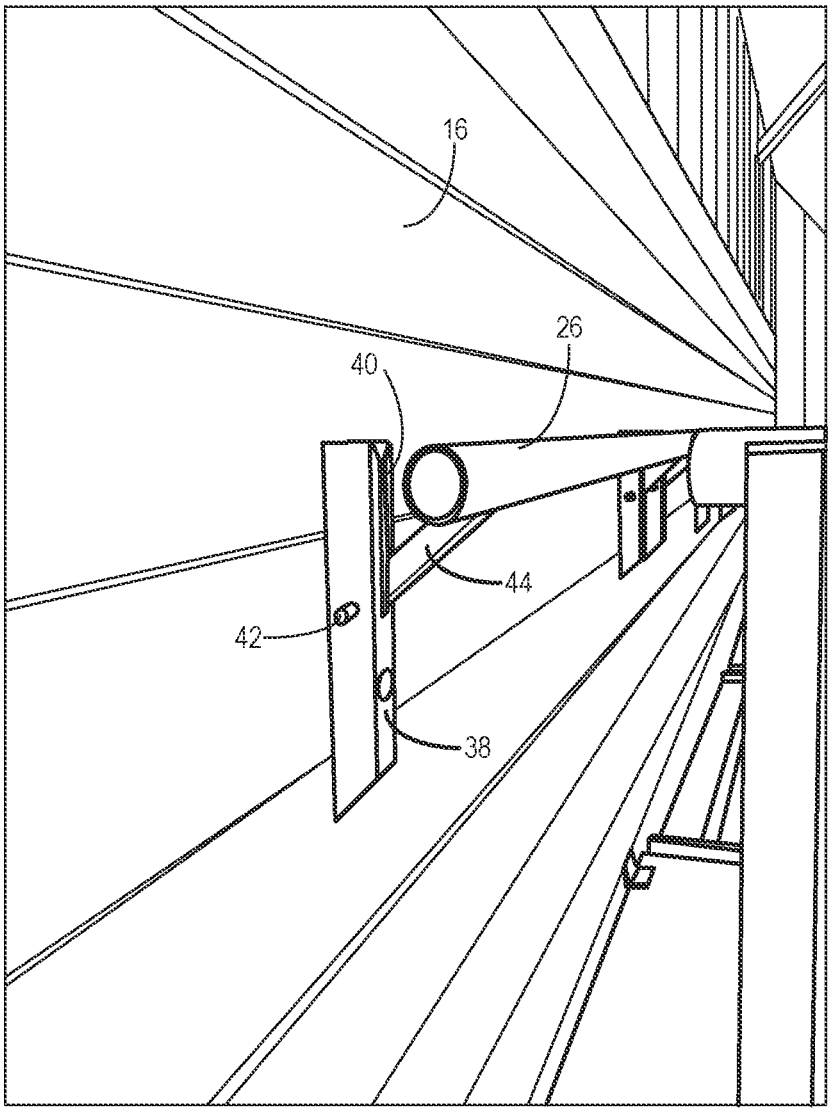
FIG. 4 shows a front perspective view of a second handrail according to some non-limiting embodiments or aspects.
Figure 5:
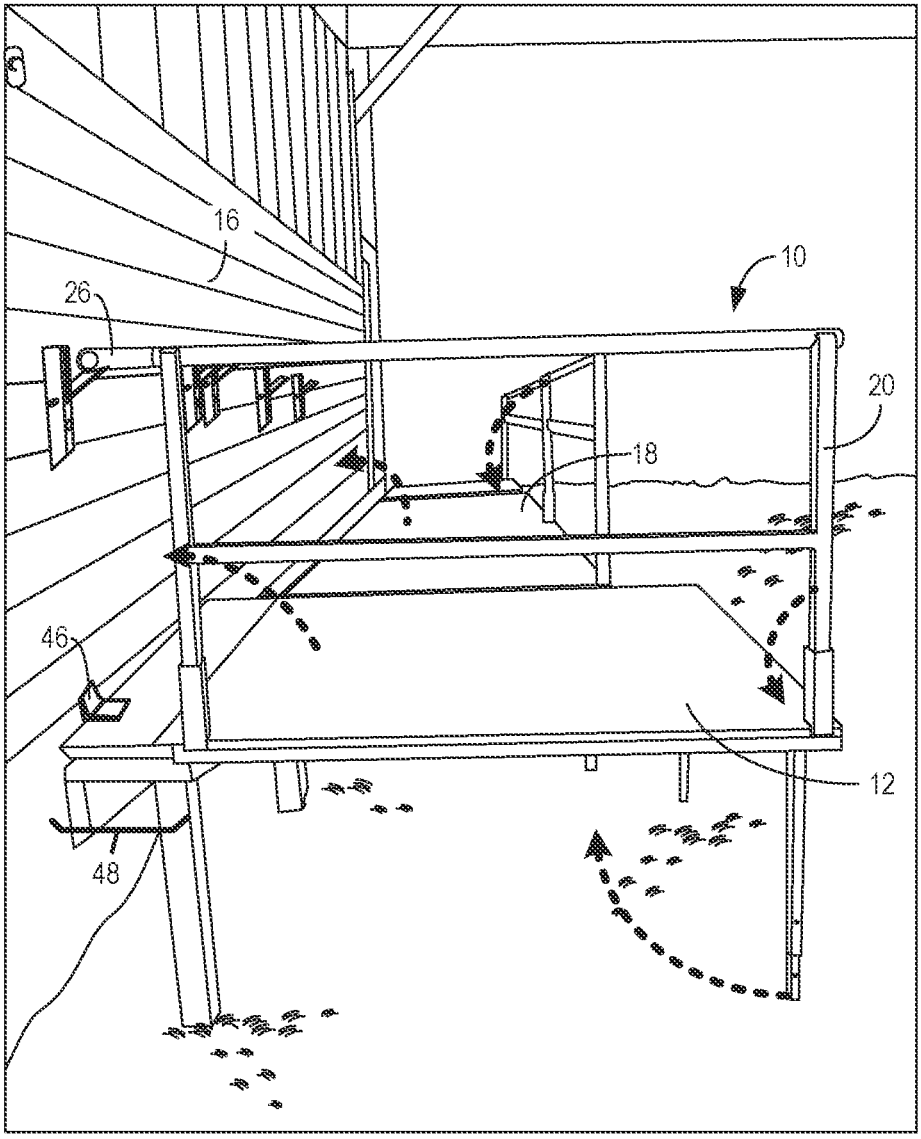
FIG. 5 shows a left side perspective view of a foldable ramp system according to some non-limiting embodiments or aspects.

For purposes of the description hereinafter, the terms "end," "upper," "lower," "right," "left," "vertical," "horizontal," "top," "bottom," "lateral," "longitudinal," and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

No aspect, component, element, structure, act, step, function, instruction, and/or the like used herein should be construed as critical or essential unless explicitly described as such. Also, as used herein, the articles "a" and "an" are intended to include one or more items and may be used interchangeably with "one or more" and "at least one." For example, "a handrail" or "a support" means "at least one handrail" or "at least one support".

The present disclosure is directed to a foldable ramp system adjustable between a first position and a second position in which: in the first position, the foldable ramp system comprises: a landing region substantially parallel to and elevated above a ground, wherein the landing region is mounted to a wall; and an inclined region extending from an end of the landing region toward the ground, wherein the inclined region is mounted to the wall; and in the second position, the landing region and the inclined region are folded against the wall.

Referring to FIGS. 1-5, a foldable ramp system 10 is shown according to some non-limiting embodiments or aspects. The foldable ramp system 10 may be adjustable between a first position (unfolded) and a second position (folded). The foldable ramp system 10 may comprise a landing region 12 and an inclined region 18. The landing region 12 and the inclined region 18 may be mounted to a wall 16. The landing region 12 and the inclined region 18 may be mounted to the wall 16 by a wall mount 46 which may comprise any device capable of fastening the landing region 12 and the inclined region 18 to the wall 16. The foldable ramp system 10 may comprise a single landing region 12 or a plurality of landing regions 12. The foldable ramp system 10 may comprise a single inclined region 18 or a plurality of inclined regions 18.

In the first position, the landing region 12 may be substantially parallel (within 5° of parallel) to the ground 14. The landing region 12 may be elevated above the ground 14 so that the landing region 12 (a platform) does not directly touch the ground 14.

In the first position, the inclined region 18 may extend from an end of the landing region 12 toward the ground 14. The inclined region 18 may extend from an end of the landing region 12 to the ground 14, so as to constitute a ramp between the ground 14 and the landing region 12.

In the second position, the landing region 12 and the inclined region 18 may be folded against the wall. The landing region 12 and the inclined region 18 may be rotatably mounted to the wall 16 so as to be configured to rotate between the first, unfolded position and the second, folded position. In the second position, the foldable ramp system 10 may protrude less than 12 inches from the wall 16, such as less than 8 inches or less than 6 inches (see protrusion width 48).

With continued reference to FIGS. 1-5, in the first position, the foldable ramp system 10 may be unfolded so as to enable a user to mount a riding animal by ascending the inclined region 18 to the landing region 12 and mounting the riding animal at a mounting region 28 of the landing region 12. The mounting region 28 of the landing region 12 may not comprise a handrail so that the user has unobstructed access to the riding animal. The riding animal is not particularly limited and may include any animal that may be ridden by a user, such as a horse, bull, camel, mule, etc.

With continued reference to FIGS. 1-5, in the second position, the foldable ramp system 10 may be folded tightly against the wall 16 when not in use so as to be out of the way of a riding area 32. In this second position, the foldable ramp system 10 may minimally protrude from the wall 16 so as to maximize the riding area 32 and to minimize or eliminate possible injury to the riding animal by contact with the folded foldable ramp system 10. In some non-limiting embodiments, the foldable ramp system 10 may fold completely into the wall 16 so as to not protrude therefrom at all.

With continued reference to FIGS. 1-5, the foldable ramp system 10 may further comprise a handrail 20 mounted to a top side of the landing region 12 and/or a top side of the inclined region 18. When the foldable ramp system 10 is unfolded, the handrail 20 may be substantially perpendicular (within 5° of perpendicular) to the landing region 12 and/or the inclined region 18 so as to function as a handrail 20 for the user of the foldable ramp system 10. When the foldable ramp system 10 is in the folded second position, the handrail 20 may be arranged substantially parallel to the landing region 12 and/or the inclined region 18. The handrail 20 may be folded into the substantially parallel position and may contact the landing region 12 and/or the inclined region 18 in this position. The handrail 20 may be folded from the substantially perpendicular position to the substantially parallel position by being rotatably mounted to the top side of the landing region 12 and/or the inclined region 18. The handrail 20 may be rotatably mounted thereto using any suitable mechanism. The handrail 20 may be locked in the substantially perpendicular position or the substantially parallel position as desired using any suitable locking mechanism. The substantially perpendicular arrangement of the handrail 20 enables the handrail 20 to function as a handrail for the user of the foldable ramp system 10, while the substantially parallel position folding the handrail 20 down to the landing region 12 and/or the inclined region 18 enables consolidation of the components of the foldable ramp system 10 so that the foldable ramp system 10 may be more easily folded into the wall 16 and so that the foldable ramp system 10 folded into the wall 16 may only minimally protrude therefrom. Thus, the substantially parallel position of the handrail 20 facilitates compact storage of the foldable ramp system 10.

With continued reference to FIGS. 1-5, the foldable ramp system 10 may further comprise a plurality of supports 22 mounted to a bottom side of the landing region 12 and/or a bottom side of the inclined region 18. When the foldable ramp system 10 is unfolded, the plurality of supports 22 may be substantially perpendicular to the landing region 12 and/or the inclined region 18 and/or engage with the ground 14 so as to function as legs to support the landing region 12 and/or the inclined region 18. When the foldable ramp system 10 is in the folded second position, the plurality of supports 22 may be arranged substantially parallel to the landing region 12 and/or the inclined region 18. The plurality of supports 22 may be folded into the substantially parallel position and may contact the landing region 12 and/or the inclined region 18 in this position. The plurality of supports 22 may be folded from the substantially perpendicular position (and/or the ground-engaging position) to the substantially parallel position by being rotatably mounted to the bottom side of the landing region 12 and/or the inclined region 18. The plurality of supports 22 may be rotatably mounted thereto using any suitable mechanism. The plurality of supports 22 may be locked in the substantially perpendicular (and/or ground-engaging position) position or the substantially parallel position as desired using any suitable locking mechanism. The substantially perpendicular arrangement (and/or ground-engaging position) of the plurality of supports 22 enables the plurality of supports to support the landing region 12 and/or the inclined region 18, while the substantially parallel position folding up to the landing region 12 and/or the inclined region 18 enables consolidation of the components of the foldable ramp system 10 so that the foldable ramp system 10 may be more easily folded into the wall 16 and so that the foldable ramp system 10 folded into the wall 16 may only minimally protrude therefrom. Thus, the substantially parallel position facilitates compact storage of the foldable ramp system 10. The plurality of supports 22 may fold into the landing region 12 and/or the inclined region 18 so as to avoid protruding therefrom, such that, when in the second position, no portion of the plurality of supports protrudes from the wall 16 to pose an injury risk to the riding animal.

Figure 7:
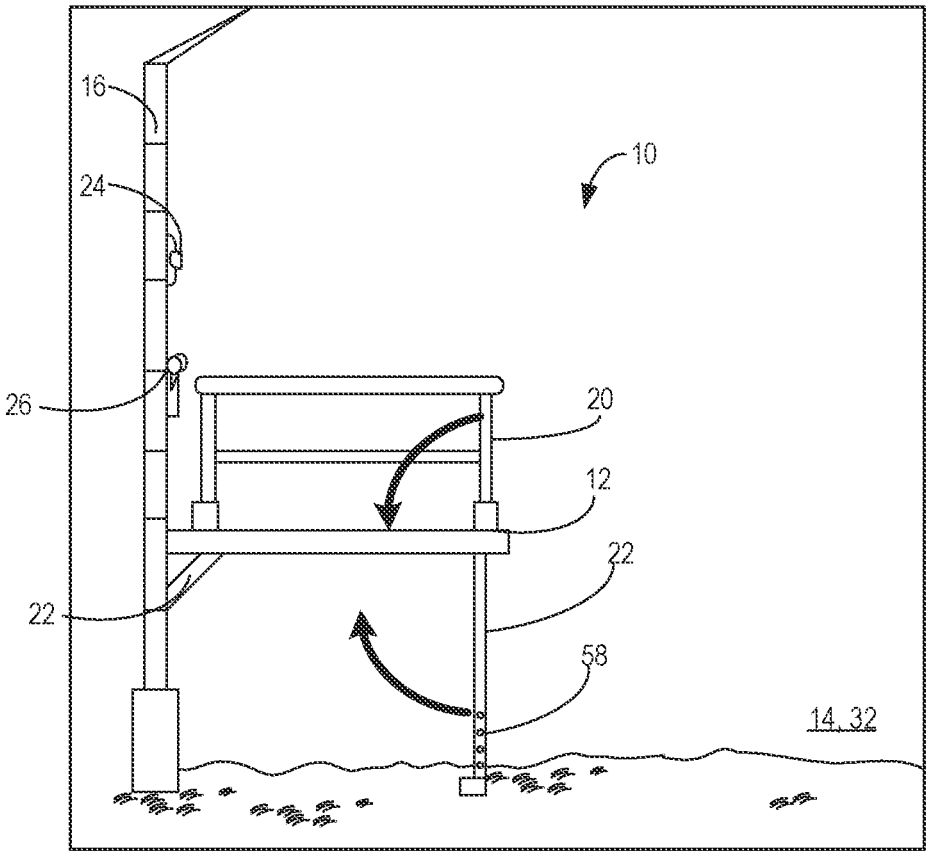
FIG. 7 shows a left side view of a foldable ramp system according to some non-limiting embodiments or aspects.
Figure 9:
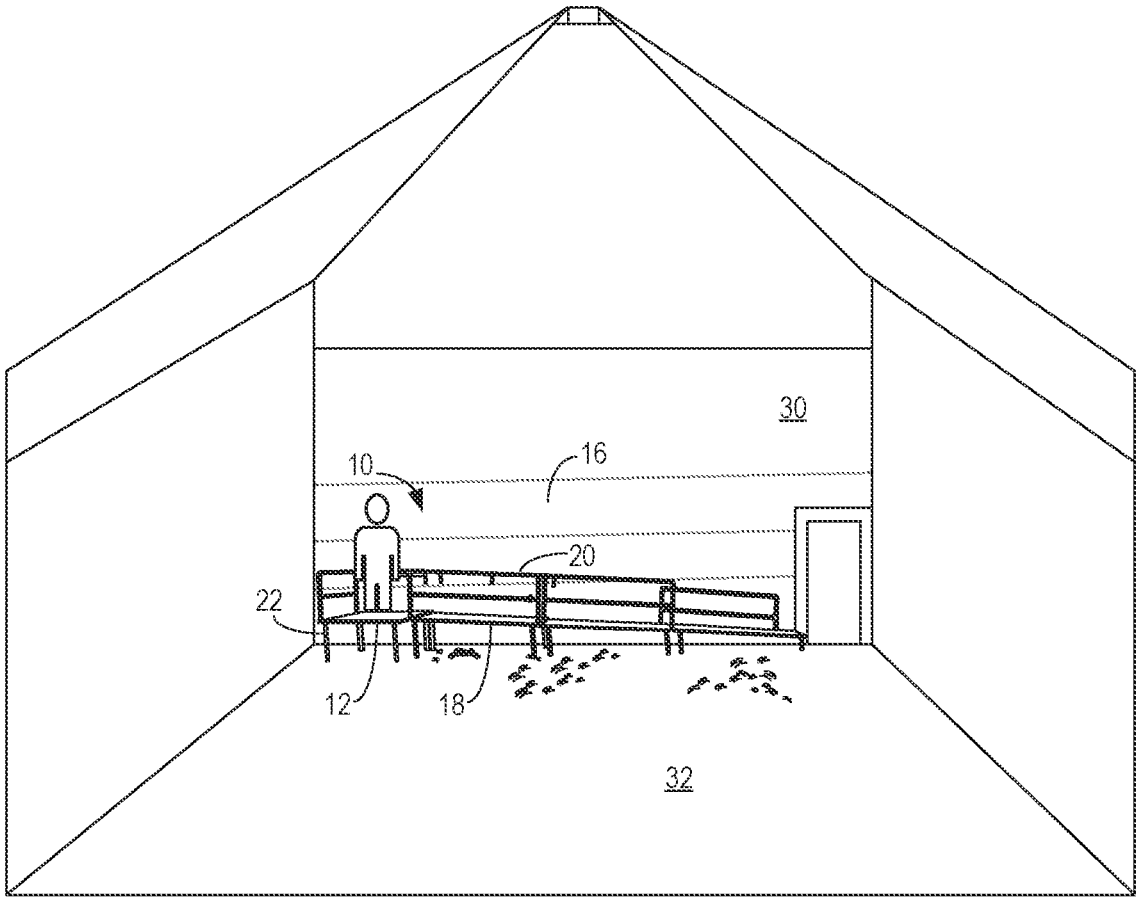
FIG. 9 shows a view of a riding arena comprising a foldable ramp system according to some non-limiting embodiments or aspects.
Figure 10:
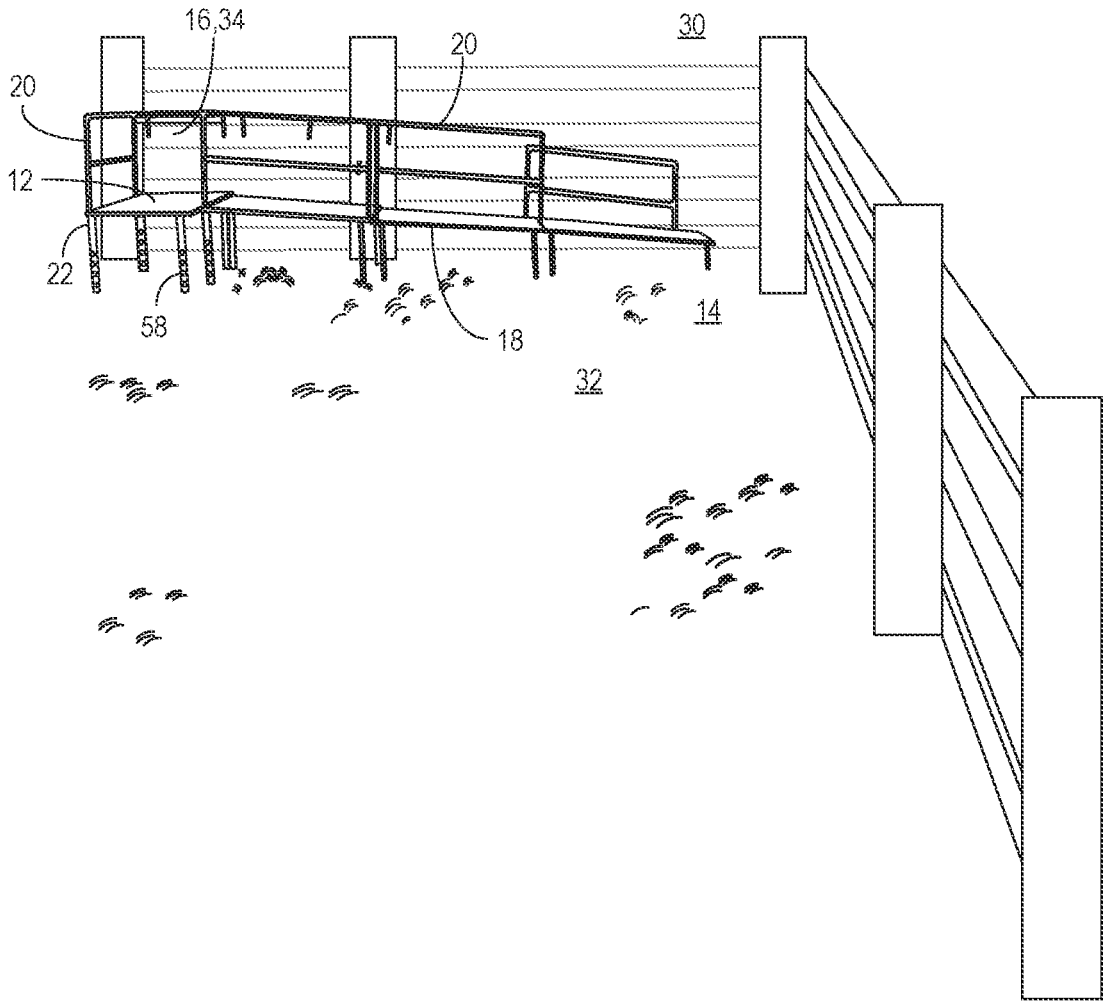
FIG. 10 shows a view of a riding arena comprising a foldable ramp system according to some non-limiting embodiments or aspects.

Referring to FIGS. 7 and 10, the plurality of supports 22 may engage the ground 14 to support the landing region 12 and/or the inclined region 18. Because the ground 14 may be expected to be uneven, particularly when the foldable ramp system 10 is introduced into a riding area 32, the ground 14 may be uneven across a length of the foldable ramp system 10. The plurality of supports 22 may be individually adjustable in length to account for the uneven ground 14. The plurality of supports 22 may be adjustable in length according to any suitable mechanism. For example, as shown in FIGS. 9 and 10, the plurality of supports 22 may comprise a support adjuster 58 to enable adjustment of the length of each of the plurality of supports 22, such as via a telescoping arrangement including a first portion of the support 22 moving relative to a second portion of the support 22 to select a length of the support 22 with the support adjuster 58 including a plurality of rod holes on the first portion and a button on the second portion, and the length of the support 22 is fixed by engaging the button with the rod hole corresponding to the desired length.

Figure 6:
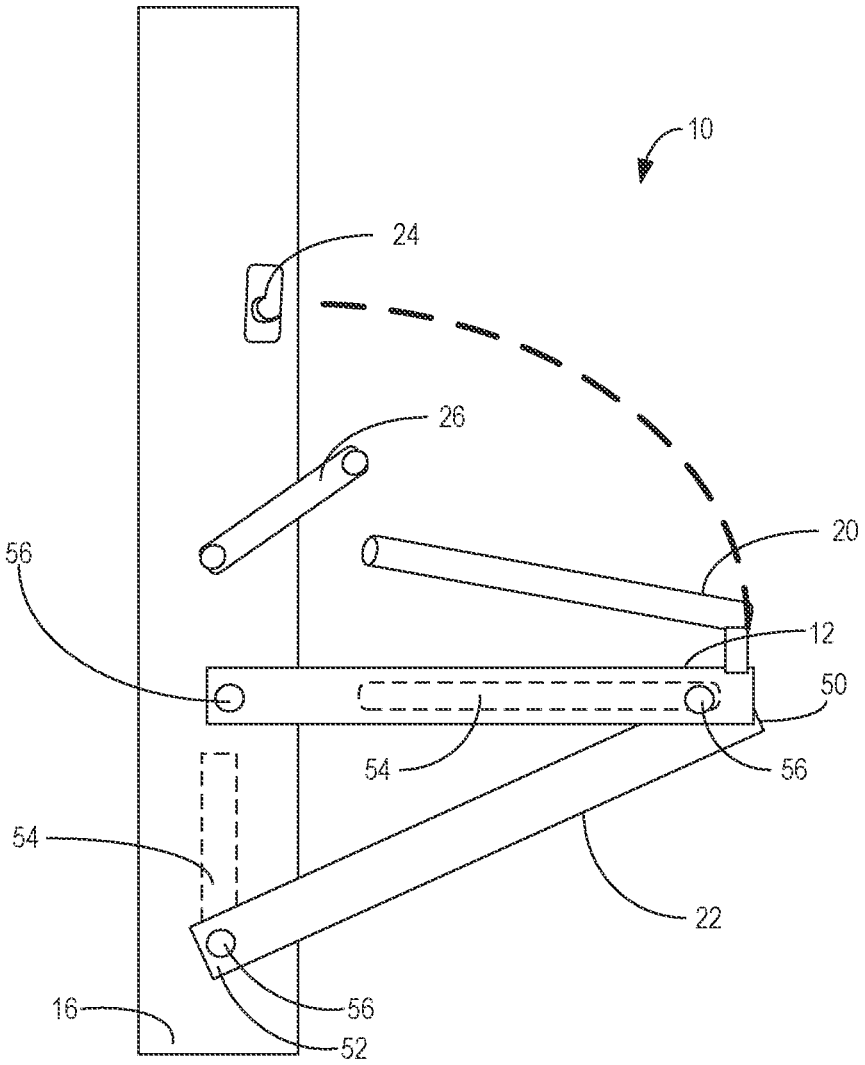
FIG. 6 shows a left side view of a foldable ramp system according to some non-limiting embodiments or aspects.

Referring to FIGS. 6 and 7, in additional and/or alternative non-limiting embodiments, a plurality of supports 22 may be included that do not engage the ground 14. For such supports 22, they may be mounted, on a first end 50, to a bottom side of the landing region 12 and/or inclined region 18 and on a second end 52 to the wall 16. Because such supports 22 do not engage the ground 14, the uneven nature of the ground 14 is not a complicating factor to establishing a stable foldable ramp system 10. The wall 16 may function to support the landing region 12 and/or inclined region 18 in the unfolded first position. As shown in FIG. 6, the supports 22 not engaging the ground 14 may be used as the sole supports in the foldable ramp system 10, or alternatively as shown in FIG. 7, they may be used in addition to supports 22 which engage the ground 14.

Referring to FIG. 6, the plurality of supports 22 mounted, on a first end 50, to a bottom side of the landing region 12 and/or inclined region 18 and on a second end 52 to the wall 16 may be rotatably mounted thereto to facilitate adjustment of the foldable ramp system 10 from the first position to the second position. In the first, unfolded position, the first end 50 of the plurality of supports 22 may be extended further away from the wall 16 compared to when in the second, folded position. When in the second position, the plurality of supports 22 may rotate toward the wall 16 so as to be substantially parallel thereto. In this way, in the first position, the supports 22 support the unfolded foldable ramp system 10, while the second position enables consolidation of the components of the foldable ramp system 10 so that the foldable ramp system 10 may be more easily folded into the wall 16 and so that the foldable ramp system 10 folded into the wall may only minimally protrude therefrom. Thus, the second position facilitates compact storage of the foldable ramp system 10.

With continued reference to FIG. 6, the plurality of supports 22 may be rotatably mounted on a first end 50, to a bottom side of the landing region 12 and/or inclined region 18 and on a second end 52 to the wall 16 using any suitable mechanism. In the non-limiting example shown in FIG. 6, the wall 16 and the landing region 12 and/or the inclined region 18 (not shown) may have support slots 54 to enable adjustment of the supports 22. Pins 56 may be arranged at each side of the supports to engage the slots. The pins 56 at the first end 50 of the supports 22 may engage with the support slots 54 in the landing region 12 to enable the supports 22 to rotate toward the wall 16 when moving from the first positon to the second position. The pins 56 may move in the support slots 54 toward the wall 16 when folding the supports 22 toward the wall 16 to go from the first positon to the second position. The landing region 12 may be fixed to the wall 16 via a pin 56 (or any other suitable mechanism) to rotate toward the wall 16 to fold into the second position. The pin 56 at the second end 52 of the support 22 may engage with the support slot 54 in the wall 16 to adjust the angle of the support 22 relative to the landing region 12. Moving the pin 56 up in the support slot 54 may reduce the angle between the support 22 and the landing region 12, while moving the pin 56 down in the support slot 54 may increase the angle between the support 22 and the landing region 12.

Referring to FIGS. 1, 2, 6, and 7, the foldable ramp system 10 may further comprise at least one bracket 24 mounted to the wall 16 and configured to engage the landing region 12 and the inclined region 18 in the second position to secure the landing region 12 and the inclined region 18 to the wall 16 in the second position. A plurality of brackets 24 may be mounted along the length of the wall 16 to engage the landing region 12 and the inclined region 18 at different positions along the length of the foldable ramp system 10. The design of the bracket 24 is not particularly limited and is designed to fix the landing region 12 and the inclined region 18 to the wall 16 in the folded position in order to consolidate the components of the foldable ramp system 10 so that the foldable ramp system 10 may be more easily folded into the wall 16 and so that the foldable ramp system 10 folded into the wall may only minimally protrude therefrom.

Referring to FIGS. 1-8B, in addition to the handrail 20 mounted on the landing region 12 and/or the inclined region 18, the foldable ramp system 10 may further comprise a second handrail 26. The second handrail 26 may be mounted to the wall 16 so as to provide a handrail on the side of the landing region 12 and/or the inclined region 18 opposite the side on which the handrail 20 is mounted. The second handrail 26 may be rotatably mounted to the wall 16. In the first position in which the foldable ramp system is unfolded, the second handrail 26 may rotate to a first position in which the second handrail 26 is extended away from the wall 16 so as to function as a handrail for the user of the foldable ramp system 10. In the second position in which the foldable ramp system is folded, the second handrail 26 may rotate to a second position in which the second handrail 26 is rotated toward the wall 16 and may contact the wall 16 so as to minimize the distance from which the second handrail 26 extends from the wall 16. The second position of the second handrail 26 enables consolidation of the components of the foldable ramp system 10 so that the foldable ramp system 10 may be more easily folded into the wall 16 and so that the foldable ramp system 10 folded into the wall 16 may only minimally protrude therefrom. Thus, the second position of the second handrail 26 facilitates compact storage of the foldable ramp system 10.

Figure 8A:
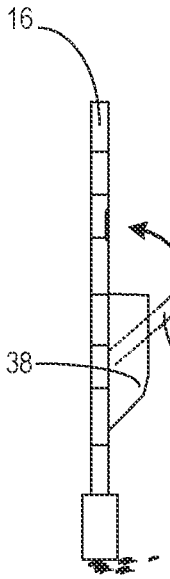
FIGS. 8A-8B show various views of the second handrail according to some non-limiting embodiments or aspects.
Figure 8B:
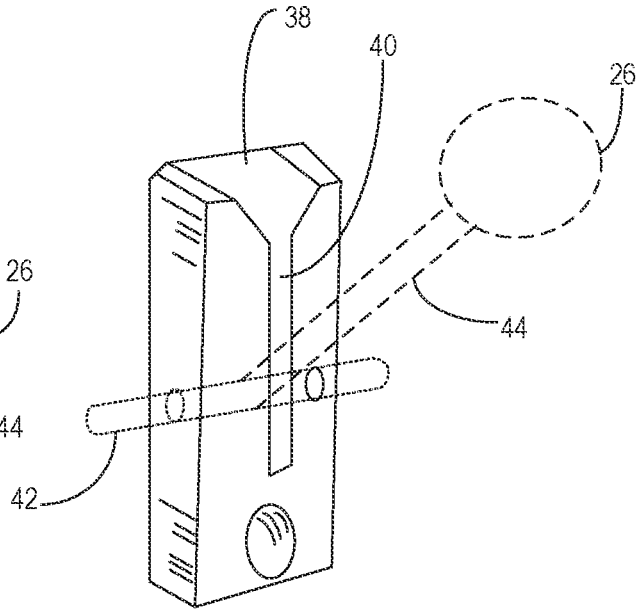

Referring to FIGS. 8A and 8B, the second handrail 26 may be rotatably mounted to the wall 16 using any suitable mechanism. In the non-limiting example shown in FIGS. 8A and 8B, a second handrail bracket 38 may be mounted to the wall 16. The second handrail bracket 38 may define a slot 40. A second handrail support 44 may comprise a first end arranged in the slot 40 and a second end mounted to the second handrail 26. The first end of the second handrail support 44 arranged in the slot 40 may be rotatably fixed to the second handrail bracket 38, such as by a pin 42. In the first position, the second handrail support 44 may protrude from the slot 40 at an angle relative to the second handrail bracket 38, and in the second position, the second handrail support 44 may be vertically arranged within the slot 40 so as to reduce the distance between the wall 16 and the second handrail 26.

Referring to FIGS. 1-7 and 9-11, the wall 16 to which the foldable ramp system is mounted may be a component of a riding arena 30 at least partially enclosing a riding area 32. The riding arena 30 may be an outdoor or indoor riding arena 30. According to this disclosure, a "riding arena" is defined broadly as any architectural structure at least partially enclosing a riding area 32. For example, the architectural structure may be a building, such as a barn, stable, indoor riding facility, fence, and the like. According to this disclosure, a "riding area" is defined broadly as any surface suitable for a riding animal to traverse. The riding area 32 may be a grass or dirt surface, for example.

As shown in FIGS. 1-5 and 9, the riding arena 30 may be an indoor riding arena having a riding area 32 therein, and the foldable ramp system 10 may be mounted to a wall 16 of the riding arena 30. As shown in FIG. 10 the riding arena 30 may be an outdoor riding arena 30 having a riding area 32 therein, and the foldable ramp system 10 may be mounted to a wall 16 of the riding arena 30, where the wall may be a fence 34 or other stable outdoor structure adjacent an outdoor riding area 32.

Referring to FIGS. 1-7 and 9-11, the present disclosure is also directed to a riding arena 30 comprising the wall 16 at least partially enclosing the riding area 32, which riding arena 30 comprises the foldable ramp system 10 described herein mounted to the wall 16.

Referring to FIGS. 1-7 and 9-11, the present disclosure is also directed to a method of arranging the foldable ramp system 10 described herein. The method may include providing a foldable ramp system comprising: the landing region 12 substantially parallel to and elevated above the ground 14, wherein the landing region 12 is mounted to the wall 16; and the inclined region 18 extends from an end of the landing region 12 toward the ground 14, wherein the inclined region 18 is mounted to the wall 16. The method may include rotating the landing region 12 and the inclined region 18 against the wall 16.

In some non-limiting embodiments or aspects, the foldable ramp system 10 may comprise the handrail 20 mounted to a top side of the landing region 12 and/or a top side of the inclined region 18. The handrail 20 may be substantially perpendicular to the landing region 12 and/or the inclined region 18. Rotating the landing region 12 and the inclined region 18 may include rotating the handrail 20 to be substantially parallel to the landing region 12 and/or the inclined region 18.

In some non-limiting embodiments or aspects, the foldable ramp system 10 may include the plurality of supports 22 mounted to the bottom side of the landing region 12 and/or the bottom side of the inclined region 18, wherein the plurality of supports 22 may be perpendicular to the landing region 12 and/or the inclined region 18 and/or the plurality of supports 22 engage the ground 14. Rotating the landing region 12 and the inclined region 18 may comprise rotating the plurality of supports 22 to be substantially parallel to the landing region 12 and/or the inclined region 18.

In some non-limiting embodiments or aspects, the foldable ramp system 10 may comprise the plurality of supports 22 mounted, on the first side, to the bottom side of the landing region 12 and/or the bottom side of the inclined region 18 and, on a second side, to the wall 16. Rotating the landing region 12 and the inclined region 18 may comprise rotating the plurality of supports 22 toward the wall 16.

Figure 11:
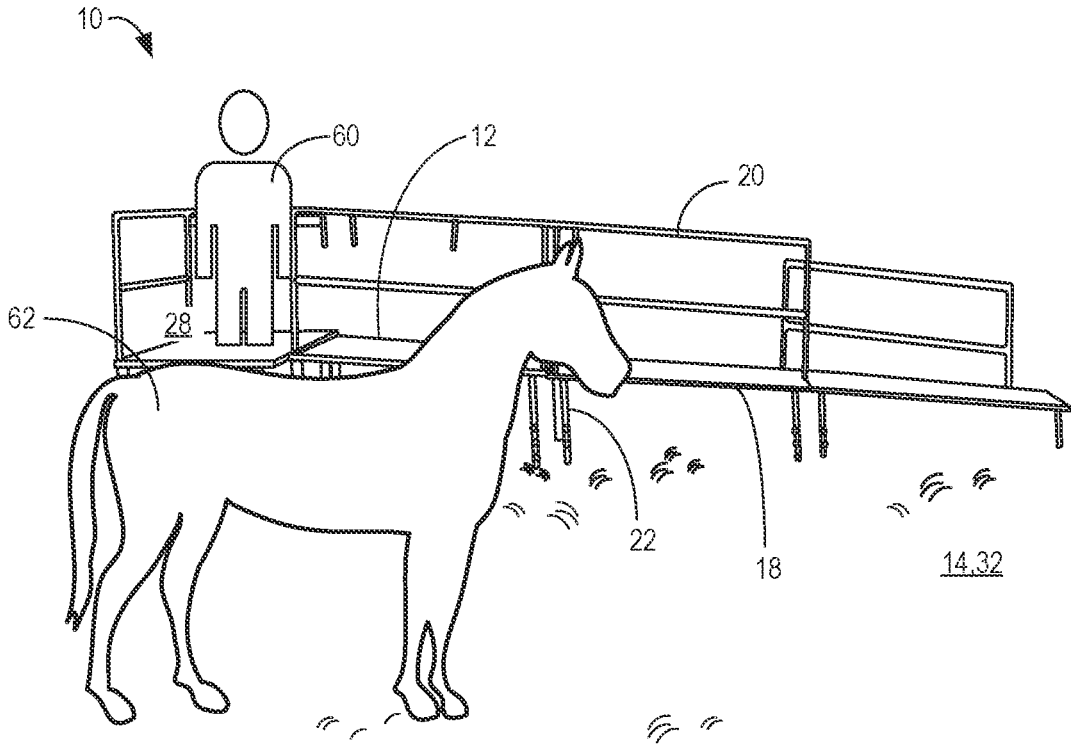
FIG. 11 shows a view of a user preparing to mount a riding animal using a foldable ramp system according to some non-limiting embodiments or aspects.
Figure 12:
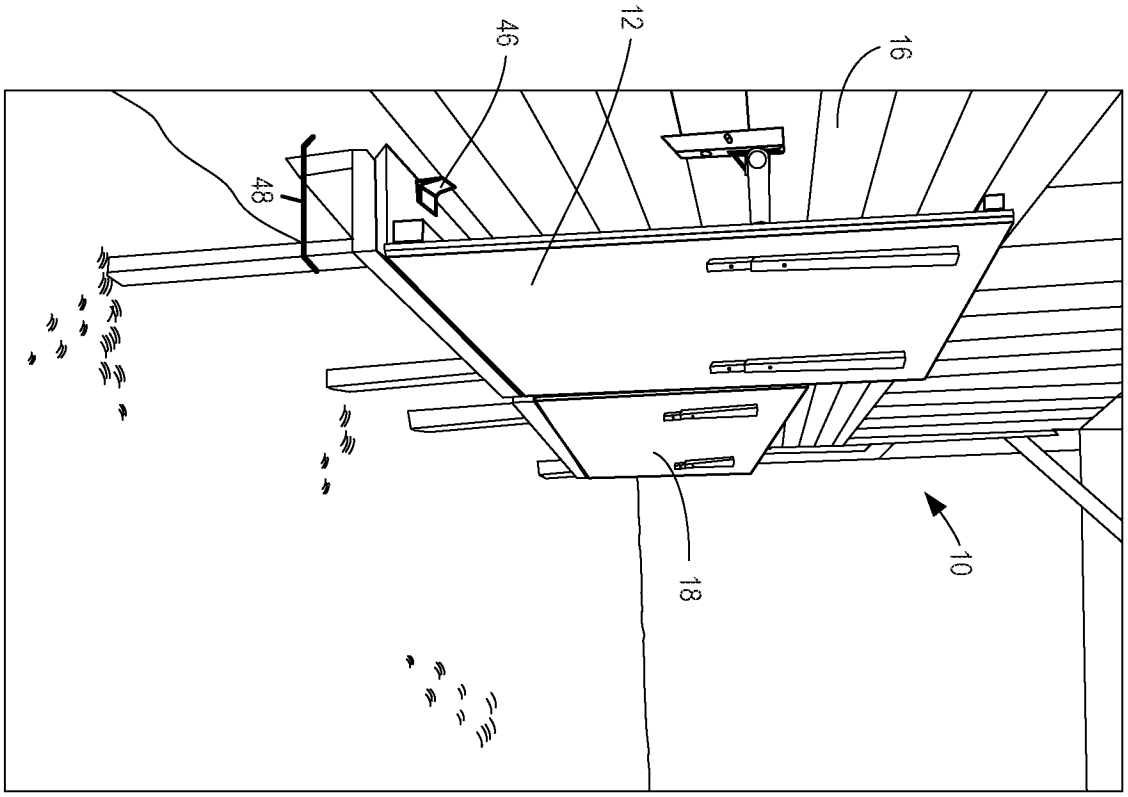
FIG. 12 shows a left side perspective view of a foldable ramp system in the second position according to some non-limiting embodiments or aspects.

Referring to FIG. 11, the foldable ramp system 10 is shown in use to enable a user 60 to mount a riding animal 62. The user 60 may mount the foldable ramp system 10 at the inclined region 18 and traverse the inclined region 18 to the landing region 12. At the landing region 12 (e.g., the mounting region 28 thereof), the user 60 may mount the riding animal 62.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent ranges that are within the spirit and scope of the appended claims. For example, it is to be understood that the present invention contemplates, to the extent possible, that one or more features of any embodiment can be combined with one or more features of any other embodiment.

What is claimed is:

1. A foldable ramp system adjustable between a first position and a second position in which:

in the first position, the foldable ramp system comprises:

a landing region substantially parallel to and elevated above a ground, wherein the landing region is mounted to a wall by at least one fastener; and an inclined region extending from an end of the landing region toward the ground, wherein the inclined region is mounted to the wall by the at least one fastener; and in the second position, the landing region and the inclined region are folded against the wall and secured to the wall by at least one bracket, the foldable ramp system further comprising:

a plurality of supports mounted to a bottom side of the landing region and/or a bottom side of the inclined region, wherein in the first position, the plurality of supports are substantially perpendicular to the landing region and/or the inclined region and/or engage with the ground, and in the second position, the plurality of supports are substantially parallel to the landing region and/or the inclined region, wherein the plurality of supports are adjustable in length.

2. The foldable ramp system of claim 1, wherein the landing region and the inclined region are rotatably mounted to the wall so as to be configured to rotate between the first position and the second position.

3. The foldable ramp system of claim 1, wherein in the second position, the foldable ramp system protrudes less than 12 inches from the wall.

4. The foldable ramp system of claim 1, further comprising a handrail mounted to a top side of the landing region and/or a top side of the inclined region, wherein in the first position, the handrail is substantially perpendicular to the landing region and/or the inclined region, and in the second position, the handrail is substantially parallel to the landing region and/or the inclined region.

5. The foldable ramp system of claim 4, wherein the landing region comprises a mounting region not comprising a handrail.

6. The foldable ramp system of claim 1, wherein the wall is a component of a riding arena at least partially enclosing a riding area.

7. The foldable ramp system of claim 1, wherein the wall is a fence.

8. A riding arena comprising a wall at least partially enclosing a riding area, wherein the riding arena comprises the foldable ramp system of claim 1 mounted to the wall.

9. The foldable ramp system of claim 1, wherein the inclined region constitutes a ramp between the ground and the landing region.

10. The foldable ramp system of claim 1, further comprising a second handrail rotatably mounted to the wall and configured to rotate from a first position in which the second handrail is extended away from the wall to a second position in which the second handrail is in contact with the wall.

11. A method of arranging a foldable ramp system, comprising:

providing a foldable ramp system comprising:

a landing region substantially parallel to and elevated above a ground, wherein the landing region is mounted to a wall; and an inclined region extending from an end of the landing region toward the ground, wherein the inclined region is mounted to the wall; and rotating the landing region and the inclined region against the wall, wherein the foldable ramp system further comprises:

a plurality of supports mounted to a bottom side of the landing region and/or a bottom side of the inclined region, wherein in the first position, the plurality of supports are substantially perpendicular to the landing region and/or the inclined region and/or engage with the ground, and in the second position, the plurality of supports are substantially parallel to the landing region and/or the inclined region, wherein the plurality of supports are adjustable in length; and/or a plurality of supports mounted, on a first end, to a bottom side of the landing region and/or a bottom side of the inclined region and, on a second end, to the wall.

12. The method of claim 11, wherein the foldable ramp system comprises a handrail mounted to a top side of the landing region and/or a top side of the inclined region, wherein the handrail is substantially perpendicular to the landing region and/or the inclined region, wherein rotating the landing region and the inclined region comprises rotating the handrail to be substantially parallel to the landing region and/or the inclined region.

13. A foldable ramp system adjustable between a first position and a second position in which:

in the first position, the foldable ramp system comprises:

a landing region substantially parallel to and elevated above a ground, wherein the landing region is mounted to a wall by at least one fastener; and an inclined region extending from an end of the landing region toward the ground, wherein the inclined region is mounted to the wall by the at least one fastener; and in the second position, the landing region and the inclined region are folded against the wall and secured to the wall by at least one bracket, the foldable ramp system further comprising a plurality of supports mounted, on a first end, to a bottom side of the landing region and/or a bottom side of the inclined region and, on a second end, to the wall.

14. A riding arena comprising a wall at least partially enclosing a riding area, wherein the riding arena comprises the foldable ramp system of claim 13 mounted to the wall.

15. The foldable ramp system of claim 13, wherein the plurality of supports are rotatably mounted to the bottom side of the landing region and/or the bottom side of the inclined region and the wall so as to facilitate adjustment of the foldable ramp system from the first position to the second position.

* * * * *